United States Patent [19]

Karns

[11] 4,324,288

[45] Apr. 13, 1982

[54] LEVEL SUPPLY AIR TEMPERATURE MULTI-ZONE HEAT PUMP SYSTEM AND METHOD

[75] Inventor: Phil J. Karns, Baldwinsville, N.Y.

[73] Assignee: Carrier Corporation, Syracuse, N.Y.

[21] Appl. No.: 120,588

[22] Filed: Feb. 11, 1980

[51] Int. Cl.[3] ..... F24F 3/00

[52] U.S. Cl. ..... 165/22; 165/28; 165/29; 236/1 B

[58] Field of Search ..... 165/22, 27, 28, 29, 165/50; 236/1 B, 49, 91 E, 91 F, DIG. 9; 62/186

[56] References Cited

U.S. PATENT DOCUMENTS

| | | | |
|---|---|---|---|
| 2,526,874 | 10/1950 | Jones | 62/6 |
| 2,885,187 | 5/1959 | Myck | 236/1 B |
| 3,724,534 | 4/1973 | Weatherston | 165/22 X |
| 3,814,173 | 6/1974 | Coon | 165/22 X |
| 3,927,713 | 12/1975 | Gilles | 165/22 X |
| 3,951,205 | 4/1976 | Zilberman | 165/22 X |
| 3,967,780 | 7/1976 | Traver | 236/49 |
| 4,013,118 | 3/1977 | Zimmer et al. | 165/22 |
| 4,099,553 | 7/1978 | Burnham et al. | 165/22 |
| 4,102,494 | 7/1978 | Coleman et al. | 236/1 B |
| 4,109,704 | 8/1978 | Spethmann | 165/22 X |

*Primary Examiner*—Albert W. Davis
*Assistant Examiner*—Margaret A. Focarino
*Attorney, Agent, or Firm*—J. Raymond Curtin; Robert P. Hayter

[57] ABSTRACT

Apparatus and method are disclosed for providing a relatively constant temperature level flow of discharge air from a reverse cycle air conditioning system. Air temperature of the air being discharged from the indoor heat exchanger of the refrigeration circuit is measured and used to control indoor fan speed to maintain the supply air temperature to the enclosure at a relatively constant temperature level. A secondary zone may be provided for receiving conditioned air from the indoor heat exchanger. A damper regulated in response to the leaving air temperature from the indoor heat exchanger is used to control the volume flow rate to the secondary zone such that as the indoor fan speed is decreased the damper decreases the volume flow rate to the secondary zone while maintaining a constant volume flow rate to the primary zone. An outdoor thermostat is provided for operating the indoor fan at normal speeds when the ambient temperature is within a predetermined range.

11 Claims, 2 Drawing Figures

LEVEL SUPPLY AIR TEMPERATURE MULTI-ZONE HEAT PUMP SYSTEM AND METHOD

BACKGROUND OF THE INVENTION

1. Field of the Invention

The present invention relates to a reverse cycle refrigeration system. More specifically, the present invention relates to a multiple zone system having means for adjusting air flow rates to maintain a relatively constant discharge temperature regardless of the fluctuation in ambient conditions.

2. Description of the Prior Art

In a conventional vapor compression refrigeration circuit the compressor acts on refrigerant to raise its temperature and pressure. Refrigerant is then condensed from a gas to a liquid in a condenser giving off heat. This liquid then undergoes a pressure drop through an expansion device and is conducted to an evaporator where it changes state from a liquid to a gas absorbing heat during the phase change. This gaseous refrigerant is then conducted back to the compressor to complete the cycle.

In the heat pump application this refrigeration circuit is arranged with a reversing valve to change the direction of refrigerant flow through the circuit such that either of the two heat exchangers may act as a condenser or an evaporator. In a conventional circuit of this description, an indoor coil is located within the air flow path for the air of the enclosure to be conditioned and an outdoor coil is located in heat transfer relation with ambient air. During the heating season the indoor coil serves as a condenser such that gaseous refrigerant is condensed to a liquid refrigerant therein giving off heat to the indoor air in heat exchange relation with the indoor heat exchanger. During the cooling season, liquid refrigerant is evaporated to a gas in the indoor heat exchanger absorbing heat from the indoor air cooling same. The outdoor heat exchanger during heating season serves as an evaporator transferring heat energy from the outdoor ambient air to the refrigerant. During the cooling season, the outdoor heat exchanger is the condenser wherein the gaseous refrigerant is condensed to a liquid discharging heat energy to the ambient air.

Heat pump system operation is dependent upon several factors, one of which is the ambient air temperature to which heat energy is either absorbed or discharged. During the heating season, when heat energy is absorbed from the ambient air and transferred through the refrigeration circuit to the indoor air, the heating capacity and efficiency of the refrigeration circuit is dependent upon the ambient air temperature from which heat energy is absorbed. As the differential between the outdoor temperature and the indoor temperature increases the efficiency and capacity of the heat pump system generally decrease.

As a result of this decrease in efficiency as the outdoor temperature drops the refrigeration circuit is capable of supplying a reduced amount of heat energy to the indoor air. Consequently, with a constant volume flow rate the indoor air in heat exchange relation with the indoor heat exchanger as the outdoor ambient air temperature drops the temperature of the indoor air leaving the indoor heat exchanger will also decrease. This presents a possible annoyance for occupants of the enclosure in that the air being discharged to heat the enclosure may be at a sufficiently low temperature to feel cool although still having the capacity to supply substantial heat energy to the enclosure.

The herein invention has, as a part thereof, a temperature sensing device for ascertaining the temperature of the air being discharged from the indoor heat exchanger during heating operation. A fan driven by an electric motor is used to circulate air through the indoor heat exchanger. Means are provided for varying the speed of the fan in response to the temperature of the discharged air from the heat exchanger such that as the capacity of the refrigeration circuit decreases, the air flow volume rate through the heat exchanger may also be decreased to maintain the leaving air temperature from the indoor heat exchanger relatively level.

The description herein further details a two zone system wherein the primary zone is connected directly to the supply plenum for receiving air from the indoor heat exchanger and whereas the secondary zone plenum receives a regulated amount of air from the supply plenum. A damper is provided for regulating the volume of the air to the secondary zone. The damper is also positioned in response to the leaving air temperature from the indoor heat exchanger. Consequently, as the indoor fan speed is reduced reducing the volume of conditioned air being supplied to the enclosure the damper may be regulated to adjust the supply of air to the secondary zone. The primary zone is always supplied with a preselected volume flow rate of air by not reducing fan speed below a predetermined level and the damper is adjusted so that the remaining volume flow rate as determined by the fan speed is conducted to the secondary zone.

SUMMARY OF THE INVENTION

An object of the present invention is to provide a heat pump system for conditioning air of an enclosure.

A further object of the present invention is to provide a heat pump system capable of supplying heated air at a relatively constant temperature.

Another object of the present invention is to vary the volume flow rate of air to be conditioned through an indoor heat exchanger such that the temperature of the air being discharged from the heat exchanger is maintained relatively constant.

Another object of the present invention is to regulate the flow of conditioned air to a secondary zone in response to the volume flow rate of air being supplied by the system.

It is a further object of the present invention to provide a safe, economical and reliable heat pump system for supplying conditioned air to an enclosure.

These and other objects are achieved according to the preferred embodiment of the invention by the provision of a refrigeration circuit having an indoor heat exchanger located in an air flow path serving a primary zone and a secondary zone. Air is circulated through the heat exchanger by an indoor fan. The speed of the indoor fan is regulated in response to the temperature level of the air being discharged from the indoor heat exchanger to maintain a generally constant level discharge temperature. Additionally, a damper is provided for regulating the volume flow to the secondary zone such that the primary zone always receives a predetermined volume flow of air and the secondary zone receives the remaining volume flow of conditioned air.

DESCRIPTION OF THE PREFERRED EMBODIMENT

The preferred embodiment as described herein will be with a refrigeration circuit adapted to be mounted with a split system heat pump. It is to be understood that any type of refrigeration circuit such as a packaged unitary unit would be equally suitable as a split system for supplying heat energy herein. It is also to be understood that while the invention is described having two zones located in specific areas of an enclosure it is likewise feasible to have varying numbers of zones located in other positions within the enclosure.

Figure 1:
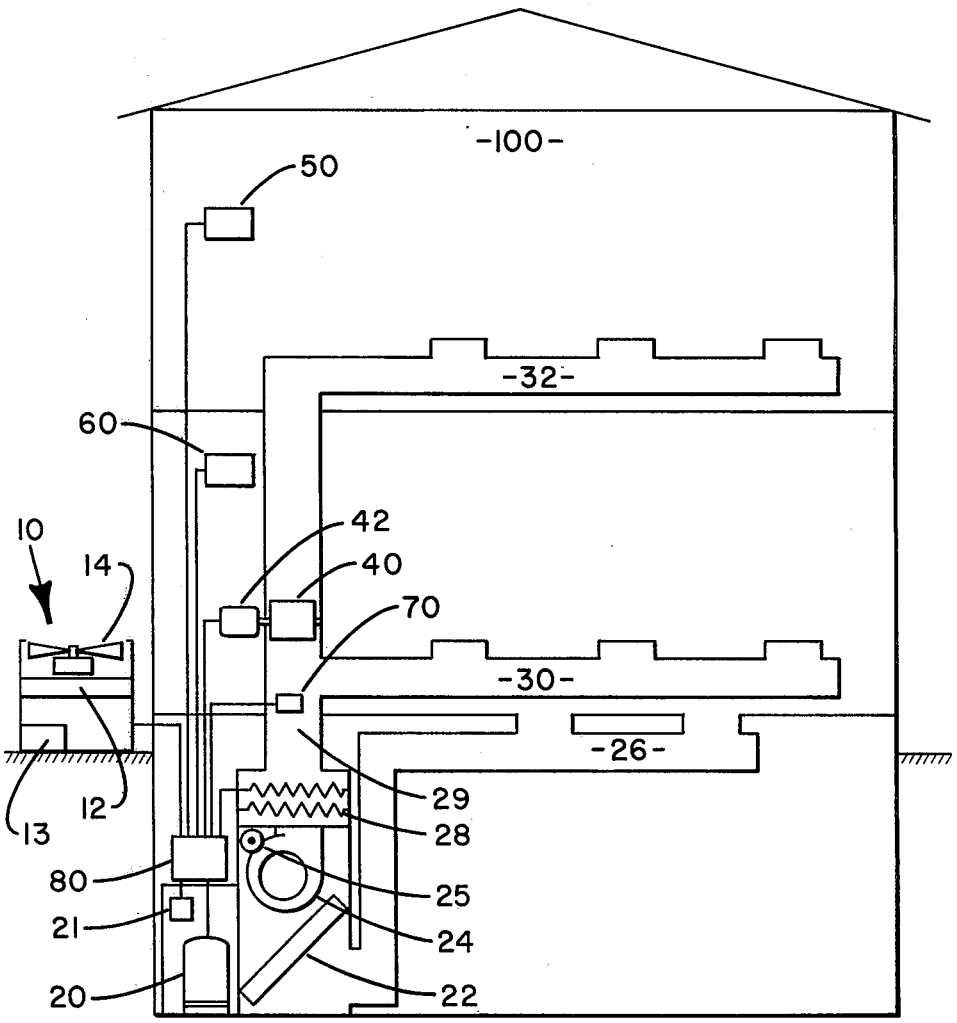
FIG. 1 is a schematic view of an enclosure having a multizone heat pump system.

Referring now to FIG. 1 there can be generally seen an enclosure 100 having an air conditioning system therein. A refrigeration circuit is provided having outdoor heat exchanger 12, compressor 20, reversing valve 21 and indoor heat exchanger 22.

The specific circuiting of the refrigeration circuit is not disclosed and it is understood that these components are connected in the usual manner such that refrigeration refrigerant flows in a closed path between the heat exchangers and the compressor to transfer heat energy between the ambient air and the indoor air. Reversing valve 21 acts to alter the direction of flow of the refrigerant such that the unit may be operated to either supply heat energy to the indoor heat exchanger or to remove heat energy from the indoor air through the indoor heat exchanger.

Outdoor unit 10 has outdoor heat exchanger 12 mounted therein and outdoor fan 14 for circulating ambient air in heat exchanger relation with the outdoor heat exchanger 12. Outdoor thermostat 13 is also included as part of the outdoor unit.

Within the enclosure the cold air return plenum 26 is shown for conducting return air to the indoor heat exchanger. Indoor fan 24 driven by indoor fan motor 25 is shown located adjacent the indoor heat exchanger for drawing air therethrough and discharging said air into supply plenum 29. Resistance heaters 28 are located between the fan and the supply plenum for adding supplemental heat. The location of the fan in relation to the indoor heat exchanger and the electrical resistance heaters is a matter of design choice and may be located upstream of the indoor heat exchanger to force air through the heat exchanger rather than drawing air through the heat exchanger as shown in FIG. 1.

Connected to supply plenum 29 is a primary zone supply plenum 30 serving the first level of enclosure 100 and secondary zone supply plenum 32 serving the second floor of enclosure 100. Located between supply plenum 29 and secondary zone supply plenum 32 is damper 40 controlled by damper motor 42.

Electrical controls shown generally leading to control 80 include a secondary thermostat 50 mounted to detect the air temperature in the second floor level, primary thermostat 60 mounted to detect the air temperature of the first floor level, temperature sensor 70 located to detect the air temperature of the air being discharged from indoor heat exchanger 22. Additionally connected to control 80 and regulated thereby are outdoor unit 10 of the refrigeration circuit, reversing valve 21, compressor 20, indoor fan motor 25, resistance heaters 28 and damper motor 42.

Figure 2:
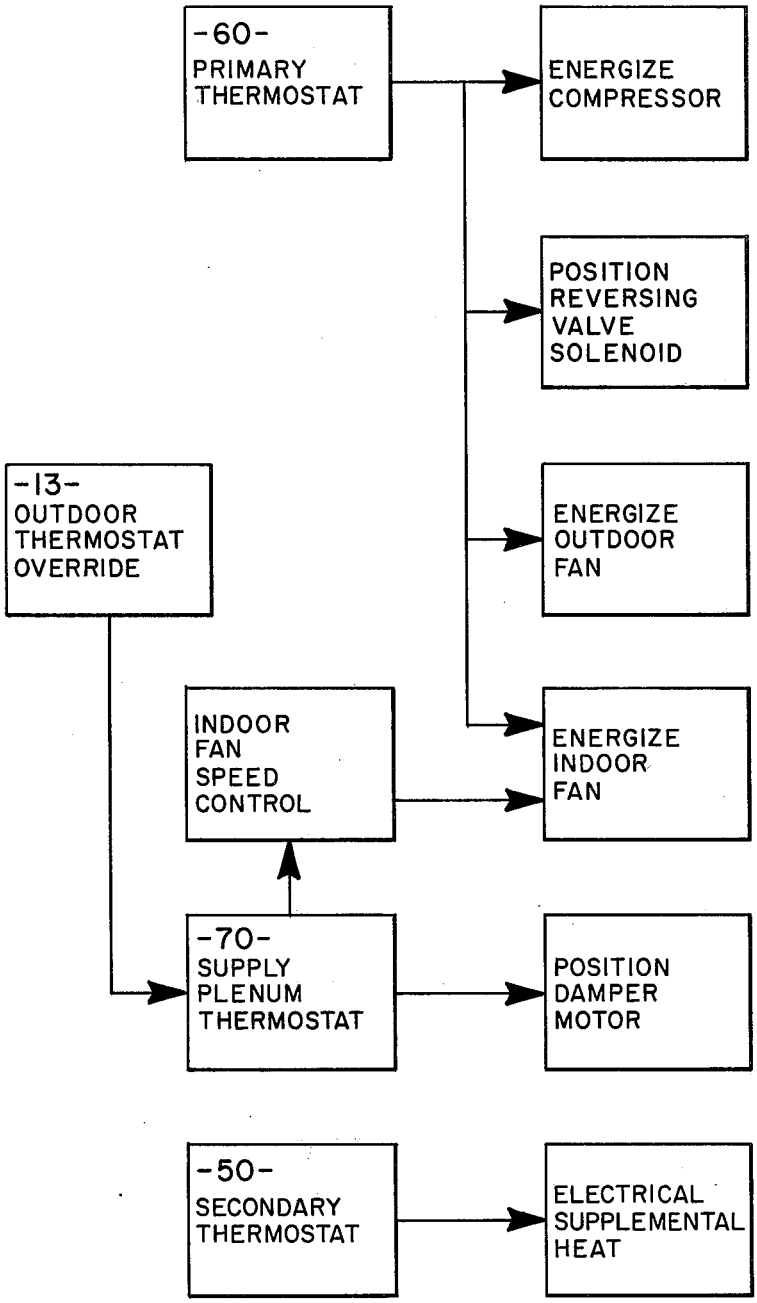
FIG. 2 is a block diagram showing the operational steps of the heat pump system.

FIG. 2 is a block diagram indicating some of the steps of operation of the unit. As can be seen in FIG. 2, block 60 labeled primary thermostat is shown connected to energize the compressor to position the reversing valve solenoid to energize the outdoor fan and to energize the indoor fan. Secondary thermostat labeled as block 50 is connected to energize the electrical supplemental heat. Supply plenum thermostat 70 is connected to indoor fan speed control 80 which is connected to the block for energizing the indoor fan. Supply plenum thermostat block 70 is additionally connected to the block labeled position damper motor. Block 13 labeled outdoor thermostat override is shown as being connected to block 70 supply plenum thermostat for overriding same under the appropriate conditions.

Operation

When a cooling need is sensed by the thermostats, the control acts to position the reversing valve in the appropriate position and to energize the refrigeration circuit thereby providing means to absorb heat energy from the indoor air at the indoor air exchanger. The indoor fan is operated and heat energy is absorbed from the indoor air in the conventional manner.

In the heating mode of operation upon the primary thermostat 60 detecting a need for heating, the refrigeration circuit is energized in the heating mode of operation. The reversing valve is positioned such that hot gaseous refrigerant discharged from compressor 20 flows to indoor heat exchanger 22 where it is condensed giving off heat to the indoor air. The outdoor fan is energized to transfer heat energy between the ambient air and the outdoor heat exchanger. The indoor fan is energized at normal speed to draw air from the cold air return through the indoor heat exchanger and discharge that air through the supply plenum to the primary zone supply plenum 30 and the secondary zone supply plenum 32. When first energized damper 40 is in the fully open position.

Upon energization, supply plenum thermostat 70 detects the temperature of the air being discharged through the supply plenum. If the temperature sensor ascertains that this air temperature is below a predetermined value than indoor fan motor 25 is controlled through the indoor fan speed control such that its speed is reduced to thereby increase the temperature of the air being discharged from the indoor heat exchanger.

The capacity of the refrigeration circuit in the heating mode is dependent upon ambient air conditions. When the ambient air conditions are sufficiently high, the heat pump system will have all the capacity necessary to heat both zones of the enclosure and the fan will be operated at normal speed to circulate sufficient air to heat both zones. As the capacity of the refrigeration circuit decreases, the capacity of the refrigeration circuit to transfer heat energy to the indoor air decreases. Consequently, if the volume flow rate of indoor air through the indoor heat exchanger remains constant and the entering air temperature of that return air remains constant the leaving temperature of the air from the indoor heat exchanger will decrease as the overall capacity of the system decreases. To avoid this decrease in the temperature of the air being drawn through the indoor heat exchanger, the volume flow rate may be decreased such that additional heat energy may be transferred to a given volume of air. Consequently, by reducing the volume flow rate as the capacity of the refrigeration circuit decreases a relatively constant level discharge temperature through the supply plenum may be maintained.

Hence, temperature sensor 70 is utilized via control 80 to regulate the indoor fan speed such that the temperature of the air being discharged through the supply plenum maintains relatively constant.

Primary zone supply plenum 30 is arranged so that it receives a predetermined volume of air notwithstanding whether the indoor fan motor speed is at a predetermined minimum speed or a higher speed. The volume flow rate of conditioned air to the secondary zone supply plenum 32 is controlled by damper 40. When the heat pump system has sufficient capacity and the indoor fan operates at full speed, damper 40 is fully open and predetermined volumes are supplied to both the primary zone and the secondary zone. As the indoor fan speed is decreased as a result of the decrease in capacity of the refrigeration system, the overall volume flow rate through supply plenum 29 decreases. Since primary zone supply plenum 30 is always supplied a predetermined volume flow rate the decrease in volume flow rate must be taken from the secondary zone supply plenum 32. Damper 40 is controlled by damper motor 42 to vary the volume of the secondary zone in conjunction with the change in indoor fan motor speed as a result of the temperature detected leaving the supply plenum. Only the volume flow rate difference between the needs of the primary zone and the volume flow rate supplied by the indoor fan is allowed to pass to the secondary zone supply plenum.

Consequently, both the indoor fan motor speed and damper 40 regulating the volume flow rate to the secondary zone supply plenum are regulated in response to the discharge temperature in supply plenum 29 of the air being conditioned.

Secondary thermostat 50 is utilized to regulate resistance heaters 28. Under normal operating conditions in many enclosures it is possible to maintain the secondary zone at a temperature lower than the primary zone. When the heat pump system is capable of meeting all heating requirements all zones are maintained at a constant temperature level. As the heat pump system capacity decreases, the conditioned air flow rate to the secondary zone decreases such that a temperature differential may be created between the two zones.

In a normal residential application, as shown in FIG. 1, the holding of second zone temperature lower than the first zone may be acceptable. If the bedrooms and other not constantly used areas of the home are located on the second floor, the utilization thereof may allow for a reduced temperature to be maintained. In addition thereto, the transfer of heat energy between the structure dividing the zones will be generally upward such that some of the heat energy supplied to the primary zone additionally travels to the secondary zone. Consequently, the homeowner may vary well choose to live with the temperature level in the second zone being somewhat reduced from that of the first zone.

Secondary thermostat 50 located in the secondary zone acts to energize resistance heaters 28 when the temperature in the secondary zone drops below a predetermined level. The energization of the resistance heaters acts to increase the temperature of the conditioned air traveling through the supply plenum which then allows, through temperature sensor 70, the indoor fan speed and the damper position to be set to provide for full volume flow to the secondary zone.

As the outdoor temperature drops beyond a predetermined point, the most efficient way to operate the refrigeration circuit is to resume normal speed indoor fan operation. At this point the capacity of the unit has dropped such that the additional energy transfer available through the higher flow rate through the indoor coil is useful in supplying heat energy to the enclosure. Control 80, upon the outdoor thermostat 13 sensing this temperature, acts to energize the indoor fan at normal speed and to allow the damper to be in the fully open position. It is believed that the point at which the fan operation should return to normal is approximately that of the balance point of the heat pump system. Consequently, upon the ambient air temperature dropping from a level when the needs of the house may be easily met to the balance point of the indoor fan speed is constantly reduced to maintain a relatively constant temperature level discharge through supply plenum 29. Once the unit senses a temperature below the balance point, the indoor fan is operated at full speed to obtain the maximum possible efficiency and heating capacity from the refrigeration circuit.

It is to be understood that the selection of the balance point temperature for this changeover or any specific temperatures will depend upon the application, system, sizing, components and other factors peculiar to the installation. The balance point as suggested as the temperature herein only as being that point where it is estimated that it would be appropriate to effect this changeover.

It is to be understood that the invention has been described herein with reference to a particular embodiment but that variations and modifications can be effected within the spirit and scope of the invention.

I claim:

1. Apparatus for supplying conditioned air to an enclosure which comprises:

a refrigeration circuit having an indoor heat exchanger for transferring heat energy between refrigerant and the air to be conditioned;

circulating means for directing air through the indoor heat exchanger;

means for regulating the volume of air circulated through the indoor heat exchanger by the circulating means;

a return plenum for supplying air to the circulating means;

a supply plenum for receiving conditioned air from the indoor heat exchanger;

a primary zone plenum connected to receive conditioned air from the supply plenum;

a secondary zone plenum connected to receive conditioned air from the supply plenum;

means for regulating the volume flow from the supply plenum to the secondary zone plenum;

means for ascertaining the temperature of the air discharged from the indoor coil; and control means for adjusting the means for regulating the volume of air circulated through the indoor heat exchanger and for regulating the volume of air flow from the supply plenum to the secondary zone plenum both in response to the temperature of the air discharged from the indoor heat exchanger.

2. The apparatus as set forth in claim 1 wherein the means for regulating the volume of air flow from the supply plenum to the secondary zone plenum is a damper positioned by a damper motor.

3. The apparatus set forth in claim 2 wherein the means for regulating the volume of air flow through the indoor heat exchanger comprises a variable speed motive source and wherein the circulating means comprises a fan rotated at varying speed by the motive source.

4. The apparatus as set forth in claim 1 and further comprising:

supplemental heating means located downstream of the indoor heat exchanger for supplying heat energy to the air flowing through the indoor heat exchanger; and a secondary zone thermostat located to sense the temperature of the enclosure in the zone supplied by the secondary zone plenum, said secondary zone thermostat being connected to energize the supplemental heating means upon a preselected air temperature condition being sensed.

5. The apparatus as set forth in claim 1 and further comprising:

an outdoor thermostat positioned to sense ambient air temperature; and wherein the control means includes means for regulating the volume of air circulated through the indoor heat exchanger and for regulating the volume of air flow from the supply plenum to the secondary zone plenum independent of the temperature of the air being discharged from the indoor heat exchanger when a preselected ambient air condition is sensed.

6. A method of controlling an air conditioning system serving an enclosure having a primary zone and a secondary zone, a primary zone plenum and a secondary zone plenum, and a refrigeration circuit with an indoor heat exchanger for conditioning air which comprises the steps of:

sensing the temperature of the air in the primary zone to ascertain a need for conditioning;

energizing the refrigeration circuit upon a demand for conditioning being ascertained by the step of sensing;

circulating air to be conditioned in heat exchange relation with the indoor heat exchanger of the refrigeration circuit at a predetermined volume flow rate;

detecting the rate of heat transfer from the refrigeration circuit to the air flowing in heat exchange relation with the indoor heat exchanger;

regulating the volume flow rate of air in heat exchange relation with the indoor heat exchanger in response to the step of detecting the rate of heat transfer; and regulating the volume flow rate from the indoor heat exchanger to the secondary zone plenum in response to the step of detecting the rate of heat transfer from the refrigeration circuit to the air.

7. The method as set forth in claim 6 wherein the step of detecting the rate of heat transfer from the refrigeration circuit to the air comprises:

ascertaining the temperature of the air being discharged from the indoor heat exchanger.

8. The method as set forth in claim 7 wherein the step of regulating the volume flow rate of air in heat transfer relation with the indoor heat exchanger comprises:

varying the speed of an indoor fan circulating air to be conditioned through the indoor heat exchanger.

9. The method as set forth in claim 7 wherein the step of regulating the volume flow rate from the indoor heat exchanger to the secondary zone plenum comprises the steps of:

mounting damper means to control the volume of flow to the secondary zone plenum; and adjusting the position of the damper means in response to the temperature of the air discharged from the indoor heat exchanger.

10. The method as set forth in claim 6 wherein the air conditioning system includes supplemental heating means and further comprising the steps of:

sensing the temperature of the air in the zone of the enclosure served by the secondary zone plenum; and energizing the supplemental heating means upon a preselected temperature condition being sensed in the zone served by the secondary zone plenum.

11. The method as set forth in claim 6 wherein the air conditioning system includes an outdoor thermostat and further comprising the steps of:

sensing ambient air temperature; and bypassing the steps of regulating the volume flow rate of air in heat exchange relation with the indoor heat exchanger in response to the step of detecting the rate of heat transfer and regulating the volume flow rate from the indoor heat exchanger to the secondary zone plenum in response to the step of detecting the rate of heat transfer when the step of sensing ambient air temperature senses a predetermined ambient air temperature condition.

* * * * *